US006453490B1

(12) United States Patent
Cardinale

(10) Patent No.: US 6,453,490 B1
(45) Date of Patent: Sep. 24, 2002

(54) BED SAFETY GUARD

(76) Inventor: Colleen Cardinale, 19 Allen Dr., Wayne, NJ (US) 07470

( * ) Notice: Subject to any disclaimer, the term of this patent is extended or adjusted under 35 U.S.C. 154(b) by 0 days.

(21) Appl. No.: 09/964,413

(22) Filed: Sep. 27, 2001

(51) Int. Cl.[7] ..... A47C 21/08
(52) U.S. Cl. ..... 5/426; 5/425
(58) Field of Search ..... 5/426, 425, 427, 5/428, 429, 430, 663

(56) References Cited

U.S. PATENT DOCUMENTS

| | | | | | |
|---|---|---|---|---|---|
| 421,656 | A | * | 2/1890 | Blanken | 5/425 |
| 2,555,228 | A | * | 5/1951 | Evers | 5/426 |
| 5,400,450 | A | * | 3/1995 | Leutsakos | 5/426 |
| 5,640,726 | A | * | 6/1997 | Fichner-Rathus | 5/426 |

FOREIGN PATENT DOCUMENTS

| | | | | |
|---|---|---|---|---|
| GB | 1466080 | * | 3/1977 | 5/425 |
| GB | 2225716 | * | 6/1990 | 5/426 |

* cited by examiner

*Primary Examiner*—Alexander Grosz
(74) *Attorney, Agent, or Firm*—Ernest D. Buff & Associates, LLC; Ernest D. Buff

(57) ABSTRACT

A bed safety guard provides additional guarding protection lengthwise of the bed. The side support or guard rail is secured against the side of the mattress by a plurality of slats extending transversely across substantially the entire width of the box spring. Each of the slats is bent at a terminal end thereof to form a fixed substantially right angle. The terminal ends cooperate with the side of the box spring to reliably secure the guard rail in position, to prevent it from being dislodged or pushed out and away from the bed by an occupant.

8 Claims, 7 Drawing Sheets

BED SAFETY GUARD

BACKGROUND OF THE INVENTION

1. Field of the Invention

The present invention relates to safety accessories; and more particularly to a bed safety guard having an improved construction operative to provide additional guarding protection lengthwise of the bed.

2. Description of the Prior Art

Various bed guards are disclosed in the prior art. U.S. Pat. No. 329,663 to McMurray, for instance, discloses a bed guard with attached slats that extend partially under the mattress. The slat is attached to a guard rail by means of a hinge. For convenience, the guard is removable; but a child could push the rail away, since it is kept in place solely by friction. U.S. Pat. No. 1,066,976 to Atkinson discloses a similar arrangement, but uses hooks attached to the bed springs. This solution, while addressing the previous problem, is impractical since bed springs are not generally exposed. Each of U.S. Pat. No. 2,722,017 to Burst, et al. and U.S. Pat. No. 3,179,957 to Norton discloses a side guard for a hospital bed. Such side guards are permanent, non-removable fixtures specifically designed for a hospital bed; they protect less than half the bed's length. U.S. Pat. No. 2,751,608 to Lucas discloses hide away bed gates. These gates are removable. They protect less than half the bed's length and are therefore inadequate for protecting children and infants. U.S. Pat. No. 2,904,799 to Berlin discloses a tubular bed guard. The guard is removable and can be readily pushed away by a child, since it is kept in place solely by friction. U.S. Pat. No. 5,437,067 to Bernstein, et al. discloses a bed guard adapted to be placed partially under the mattress, and is subject to being pushed away.

U.S. Pat. No. 5,528,785 to Petrus discloses a confining device couch converter which converts a seat cushion of a couch into a confining device for a resting baby. The Petrus device is not said to be suitable for use with a bed. U.S. Pat. No. 5,640,726 to Fichner-Rathus discloses a complex bed guard system having telescoping members and lockable and pivoting apparatus adapted to place the device in various configurations, including "H", "U" and "S" configurations. The Ficher-Rathus device is confronted with significant construction and operational problems. Such problems can be attributed to (i) required adjustments (which may be overlooked or incorrectly made when transforming the device between the "H" and "S" configurations); (ii) use of hinges and wing nuts (which can injure bed occupants, and mar the bed frame); and (iii) flexible joints (which can occasion transverse movement of the bed rail). Finally, U.S. Pat. No. 6,134,731 to Thom, et al. discloses a bed guard that requires more that one device to protect a single side of a bed.

There is a need in the art for an inexpensive bed guard that is inexpensive to construct, can be readily installed and removed, and reliably prevents sleeping infants and children from falling off the bed.

SUMMARY OF THE INVENTION

The present invention provides a bed safety guard having an improved construction operative to provide additional guarding protection lengthwise of the bed. Means are provided for securing the side support, or guard rail, to prevent it from being dislodged or pushed out and away from the bed by the bed's occupant. In one embodiment of the invention, the support system comprises a plurality of one-piece, unitary slats extending from the bed rail transversely across substantially the entire width of the box spring. The slats are bent at their terminal ends to create fixed, substantially right angles with slat sections approximately three to four inches long, which cooperate with the side of the box spring to secure the support system and prevent transverse movement of the bed rail.

Generally stated, the invention provides a bed safety guard for preventing a person from falling out of bed. The bed safety guard comprises a guard rail positioned along one side of a mattress of the bed, and a plurality of slats. Each slat is bent at its terminal end to create a first and second terminal end. These ends are fixed and substantially at right angles with slat sections which are distributed underneath and perpendicular to the mattress, and over the box spring. A means is provided for attaching the guard rail to the slats. In this manner, the first and the second terminal ends cooperate with the mattress to securely hold the guard rail in place along the side of the mattress.

Preferably, the guard rail is comprised of a rigid plank covered with a padded covering. Optionally, a second guard rail, positioned on the opposite side of the mattress, operates to prevent an occupant from falling off the opposite side of the bed.

Specifically, the present invention provides, in combination, a bed safety guard structure wherein (i) a plurality of one-piece, unitary slats extend from the bed rail transversely across substantially the entire width of the box spring; and (ii) each of the slats is bent at a terminal end thereof to form a fixed, substantially "right" angle, thereby creating slat sections, which cooperate with the side of the mattress to reliably secure the support system and prevent transverse movement of the bed rail.

The bed safety guard of this invention is inexpensive to make. It is easily removed and reinstalled without having to be bolted or otherwise permanently fastened to the bed frame. Once installed, the bed safety guard reliably prevents those sleeping from falling off the bed.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

The present invention provides a bed safety guard having a construction that advantageously provides additional guarding protection lengthwise of the bed.

Figure 1:
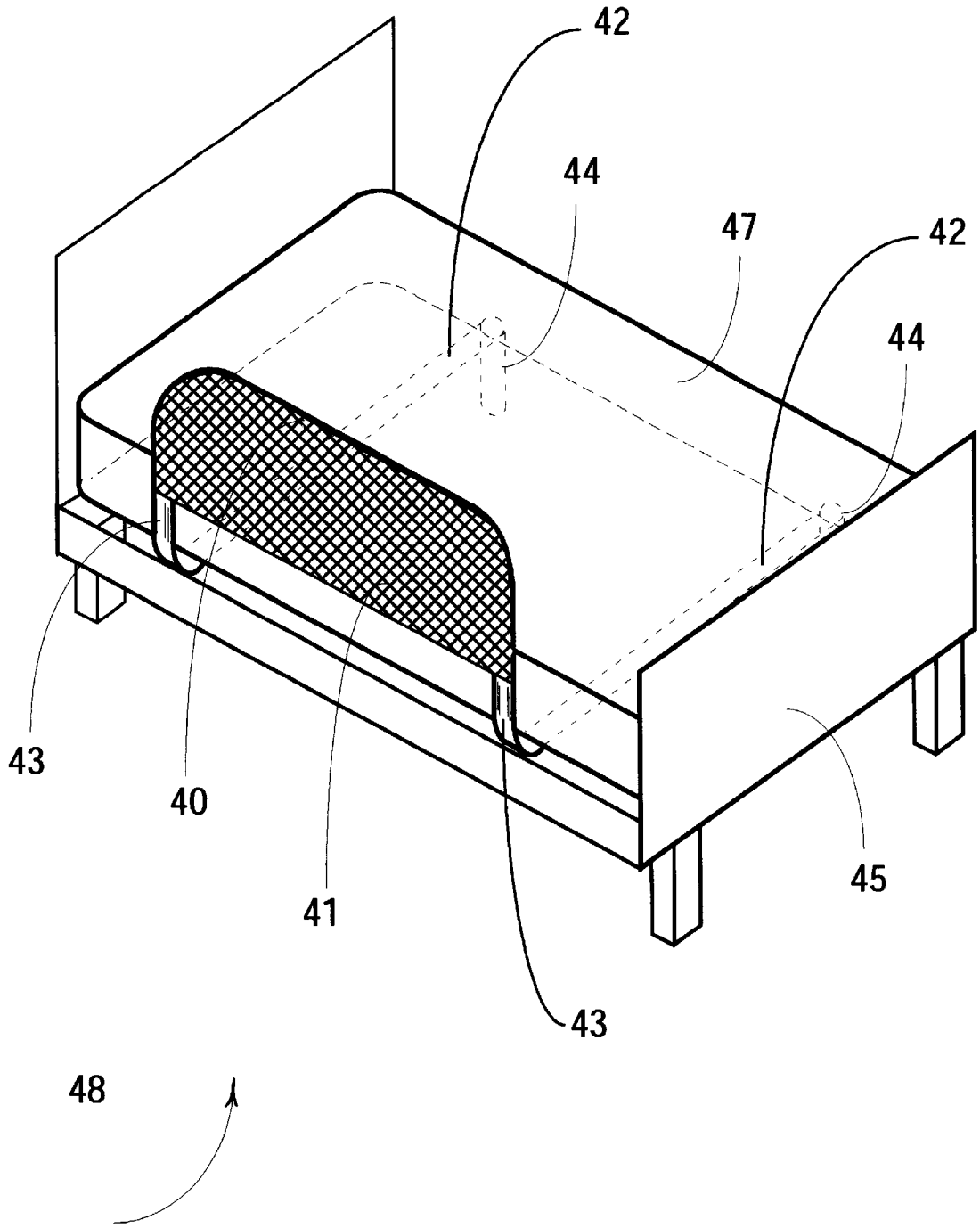
FIG. 1 is a perspective view illustrating a bed safety guard constructed in accordance with the present invention, and installed on a bed.
Figure 2:
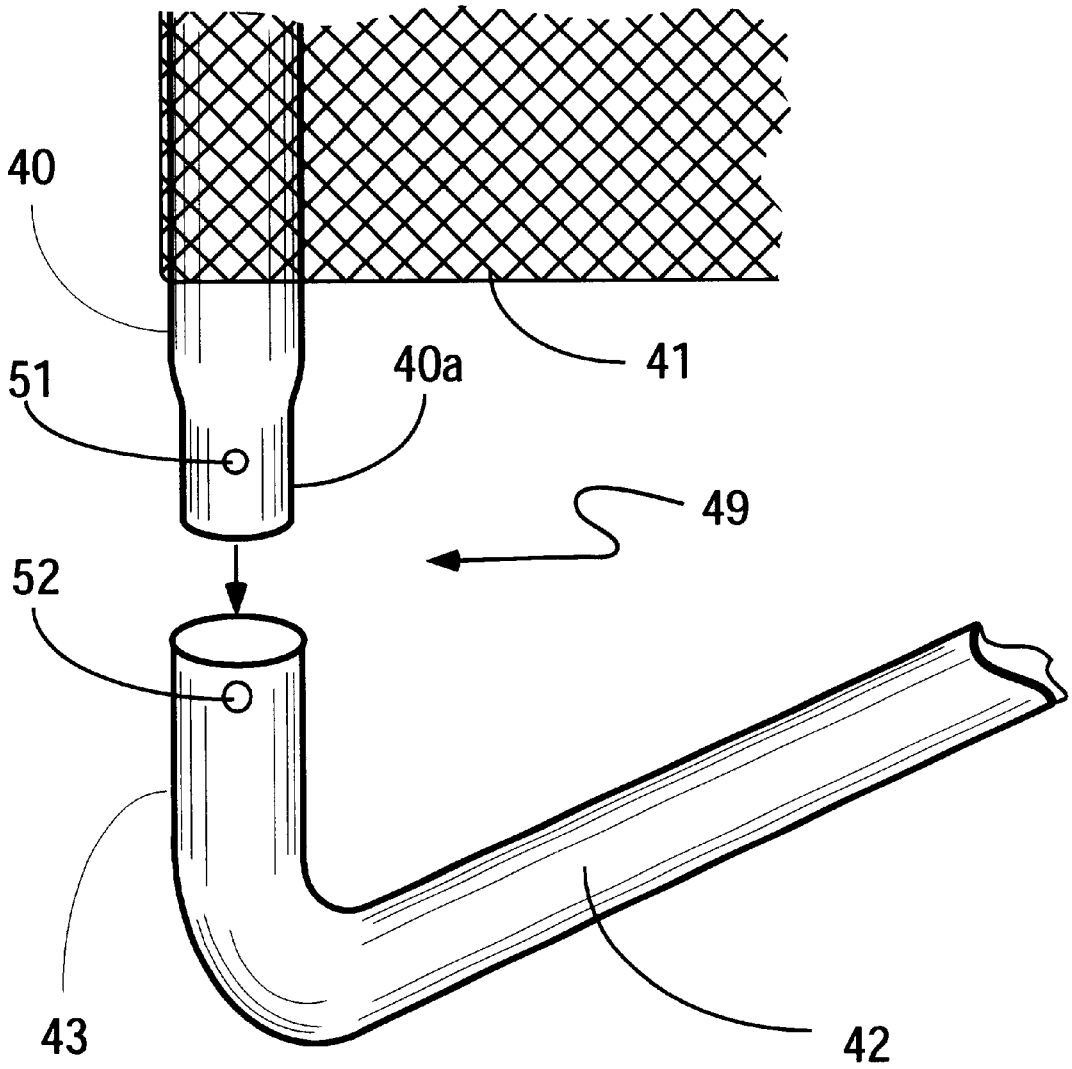
FIG. 2 is a perspective view depicting a portion of a guard rail, guard net, and a terminal end of a cross bed tube.

In FIG. 1 there is shown generally at 48 the safety bed guard of the present invention. The safety bed guard comprises guard rail 40 positioned along one side of a mattress 47 on bed 45. Guard rail 40 is a U-shaped tube having a downward facing opening therein. Guard rail 40 is provided with guard net 41 that is fastened along the inner length of guard rail 40 so as to form a barrier or wall along the substantial portion of the length of bed 45. A plurality of cross bed tubes 42 extend from guard rail 40 across mattress 47 transversely of the bed 45. As shown in FIG. 2, each tube 42 is bent at its terminal ends to create first terminal end 43 and second end 44. Terminal ends 43 and 44 are fixed and substantially at right angles with the central section of tubes 42. As noted previously, tubes 42 are distributed underneath and perpendicular to mattress 47. They are positioned under mattress 47 with terminal ends 43 pointing upward and terminal ends 44 pointing downward. An attachment means shown at 49 is provided for attaching guard rail 40 to first terminal end 43 of each tube 42. Specifically, guard rail 40 has a tapered end 40*a* that securely seats within first terminal end 43. Preferably, first terminal end 43 is provided with hole 52 for receiving spring loaded button 51 protruding from tapered end 40*a*. This means of attaching two tubes is known in the art and commonly found with the beach umbrellas and its extension pole. The tubes and guard rail are positioned below the mattress so that terminal ends 44 extend downwardly at fixed substantially right angles and are disposed immediately adjacent a box spring or other supporting structure, such as the bed frame. In this manner, second terminal ends 44 cooperate with the box spring or other supporting structure to securely hold guard rail 40 in place along the side of mattress 47. While, terminal end 43 is shown in the figures as attached to the outside of guard rail 40 (away from the mattress), it can alternately be attached to guard rail 40 on the side facing the mattress.

Figure 3:
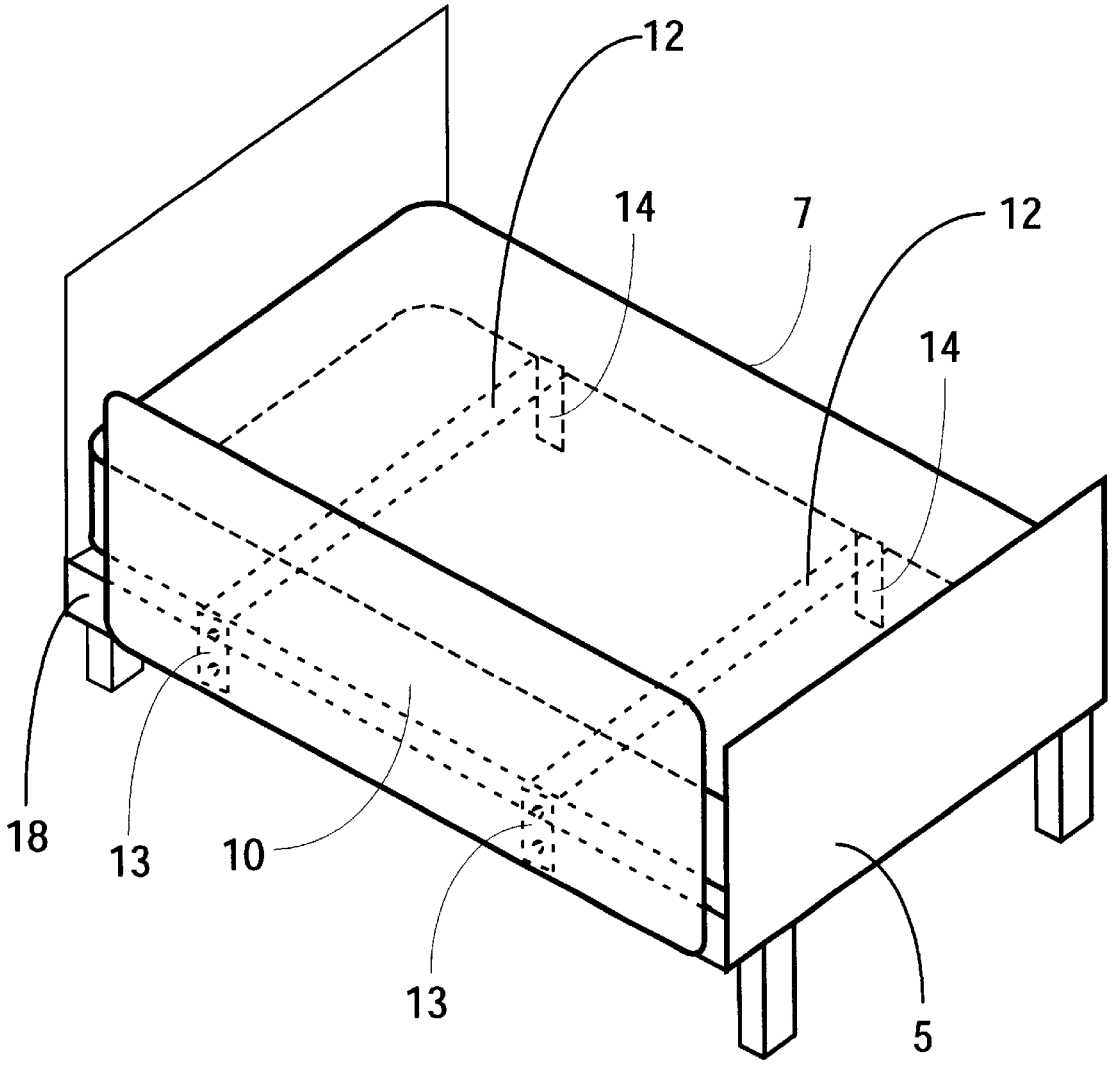
FIG. 3 is a perspective view illustrating a bed safety guard constructed in accordance with the present invention, and installed on a bed.
Figure 4:
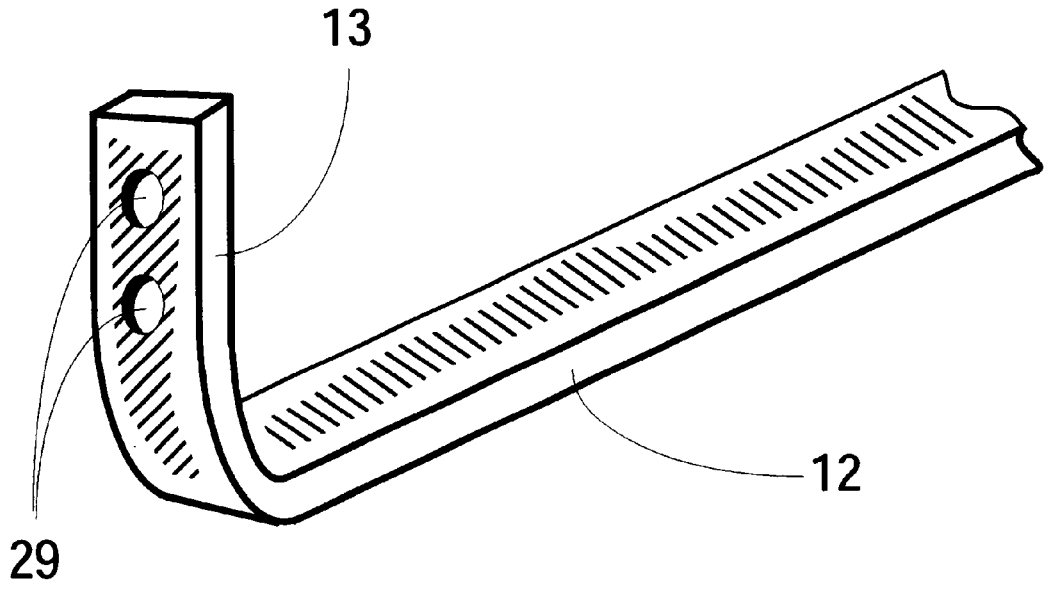
FIG. 4 is a perspective view depicting a terminal end of a slat and a portion of the slat.

In FIG. 3 there is shown the safety bed guard of the present invention. The safety bed guard comprises guard rail 10 positioned along one side of a mattress 7 on bed 5. A plurality of one-piece, unitary slats 12 extend from guard rail 10 across mattress 7 transversely of the bed 5. As shown in FIG. 4, each slat 12 is bent at its terminal ends to create first terminal end 13 and second end 14. Terminal ends 13 and 14 are fixed and substantially at right angles with the central section of slats 12. As noted previously, slats 12 are distributed underneath and perpendicular to mattress 7. They are positioned under mattress 7 with terminal ends 13 pointing upward and terminal ends 14 pointing downward. An attachment means 17 is provided for attaching guard rail 10 to first terminal end 13 of each slat 12. The slats and guard rail are positioned below the mattress so that terminal ends 14 extend downwardly at fixed substantially right angles and are disposed immediately adjacent a box spring or other supporting structure, such as the bed frame. In this manner, second terminal ends 14 cooperate with the box spring or other supporting structure to securely hold guard rail 10 in place along the side of mattress 7. While, terminal end 13 is shown in the figures as attached to the outside of guard rail 10 (away from the mattress), it can alternately be attached to guard rail 10 on the side facing the mattress.

When bed 5 has a box spring, slats 12 are placed above the box spring and below mattress 7, otherwise slats 12 are placed between the bed frame and the mattress. In either case, terminal ends 14 of slats 12 are placed adjacent the side of the box spring, bed frame or other supporting structure located furthest from terminal ends 13 and guard rail 10. This disposition of the terminal ends 14 operates to prevent transverse movement of slats 12, terminal ends 13 and guard rail 10 in a direction away from the bed frame, thereby holding guard rail 10 securely in place along the side of mattress 7.

Figure 5:
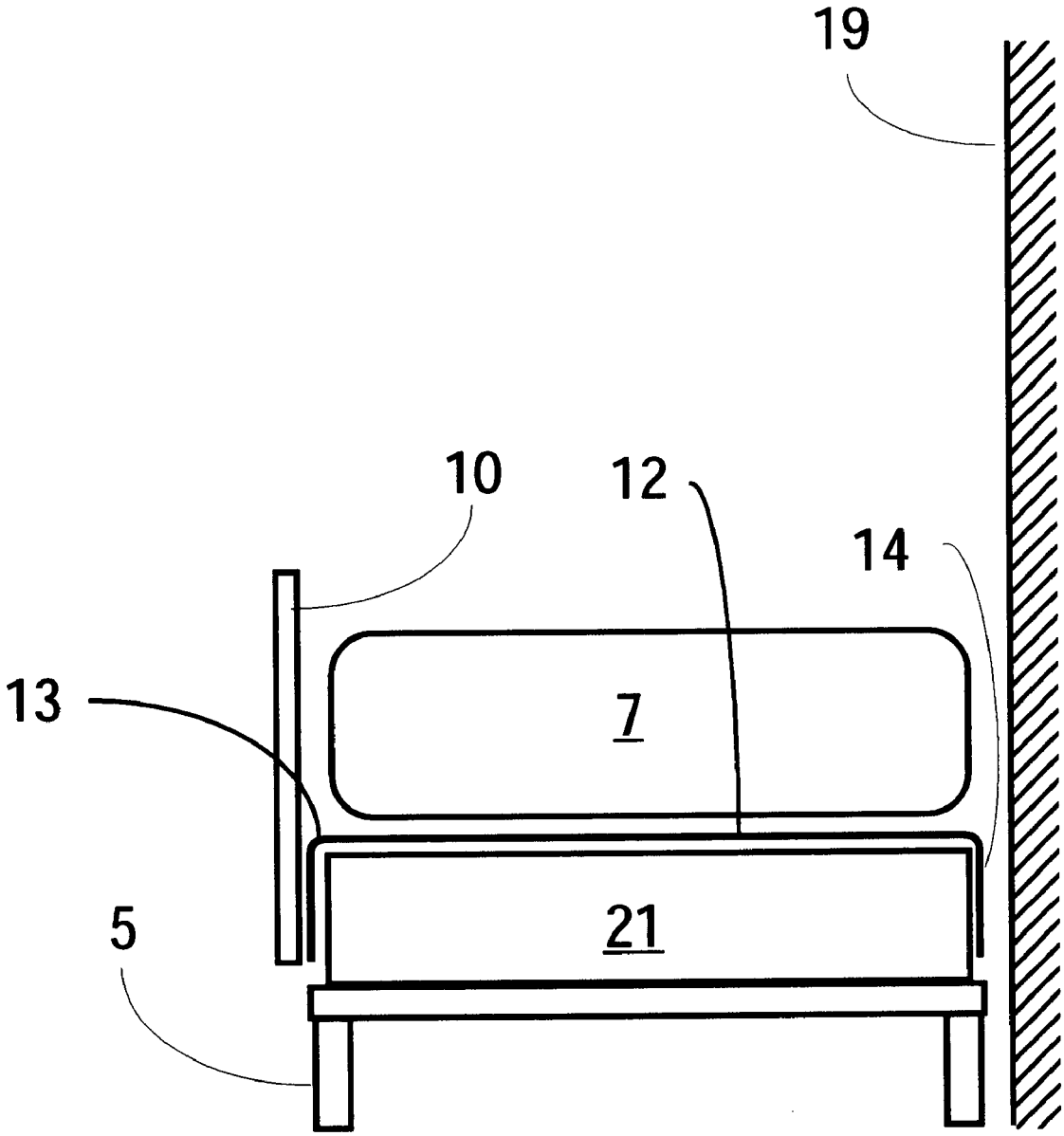
FIG. 5 is a side view depicting the safety bed guard of FIG. 1 viewed from an end of the bed situated against a wall.
Figure 6:
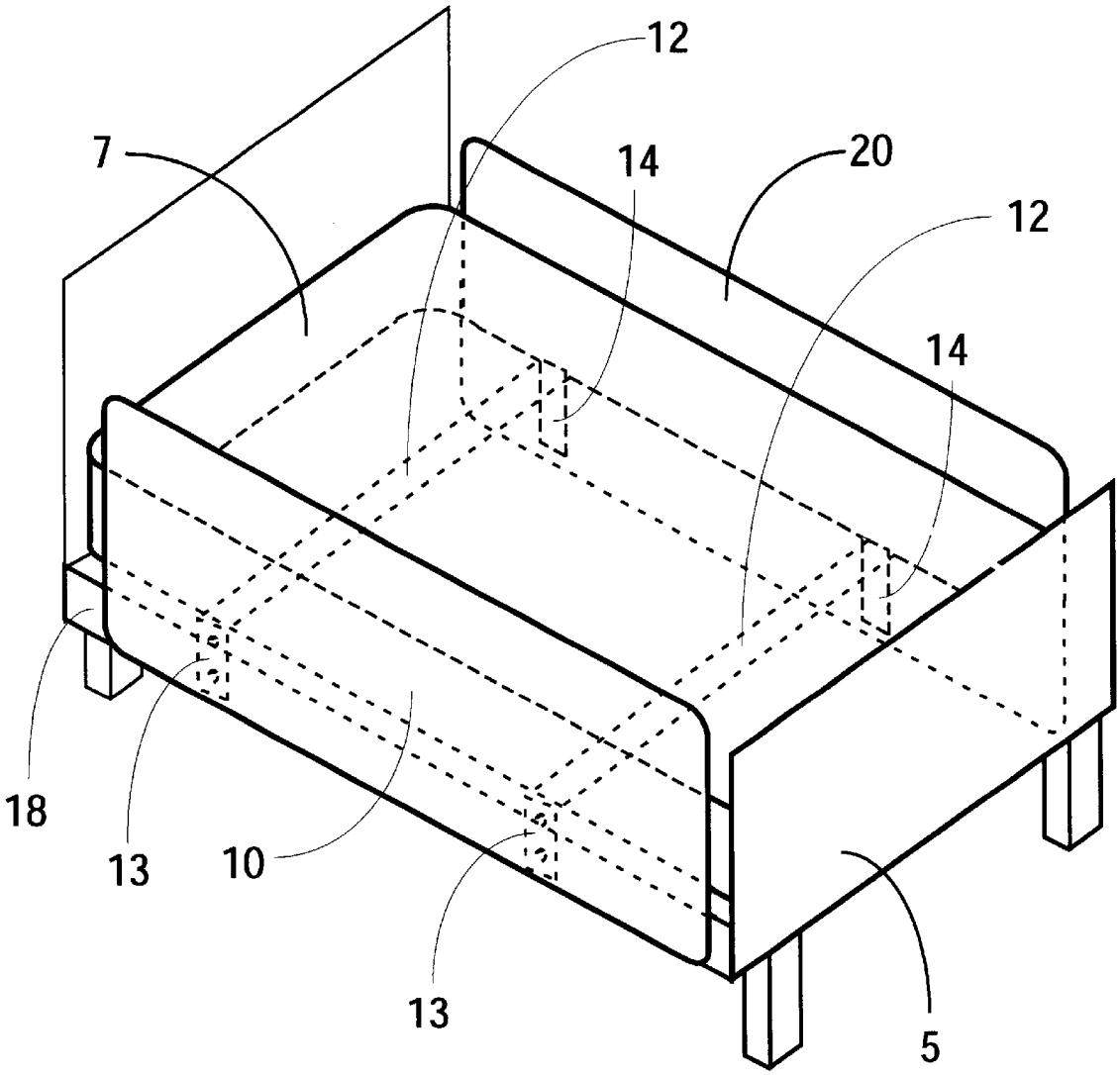
FIG. 6 is a perspective view illustrating the safety bed guard of FIG. 1, provided with an optional second guard rail.

In use, bed 5 is placed against a wall, shown as 19 in FIG. 5. There may arise occasions where such an arrangement is not feasible. Under such circumstances, as shown in FIG. 6, second guard rail 20 is positioned on the opposite side of mattress 7 from guard rail 10. An attachment means 17 is provided for attaching guard rail 20 to second terminal end 14 of each slat 12. In this manner, terminal end 13 and second terminal end 14 cooperate with mattress 7 to securely hold guard rail 10 and guard rail 20 in place along opposite sides of mattress 7.

Figure 7:
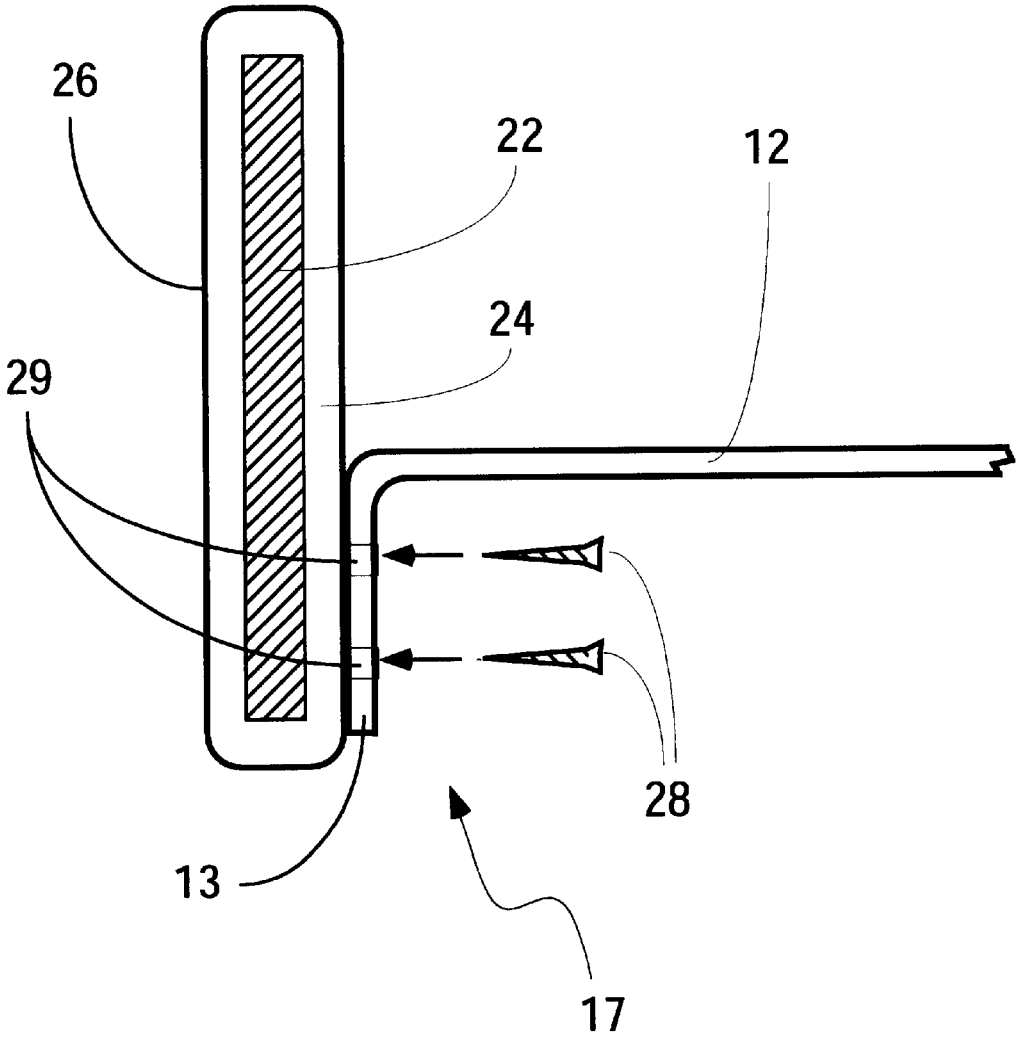
FIG. 7. shows a cross-sectional view of a padded guard rail and means of attachment.

Preferably, as shown in FIG. 7, the guard rail is comprised of rigid plank 22 covered with padding 24, in turn covered with cover 26. Cover 26 is preferably comprised of vinyl or similar dirt and water resistant material. In this case, screws 26 traverse padding 24 and cover 26 and are secured into rigid plank 22.

Attachment means 17, shown in FIG. 7, for attaching guard rail 10 to first terminal end 13 of slat 12 and guard rail 20 to second terminal end 14 of slat 12, respectively, is preferably comprised of screws 28 placed through holes 29 provided in the terminal end and into guard rail. Alternatively, attachment means 17 and 27 are comprised of various attachment devices known in the art, such as rivets, nails, adhesives, clamps or the like.

The bed safety guard is inexpensive to construct. It is not bolted or otherwise permanently fastened to the bed frame. Consequently, it is especially suited to be readily removed and reinstalled. In the installed condition, the bed safety guard reliably prevents those sleeping from falling off the bed.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A bed safety guard for preventing a person from falling out of bed, comprising:

a. a guard rail positioned along one side of a mattress and box spring of said bed;

b. a plurality of one-piece unitary slats, each slat being bent at its terminal ends to create first and second terminal ends fixed and substantially at right angles with slat sections distributed underneath and perpendicular to said mattress, and over said box spring;

c. attachment means for securing said guard rail to said first terminal ends of said slats; and d. said second terminal ends extending downwardly adjacent a side of said box spring and cooperating with said first terminal ends to hold said slats firmly against said side of said box spring, whereby said first and second terminal ends cooperate with said box spring to securely hold said guard rail and said one-piece unitary slats in place against the side of said mattress.

2. A bed safety guard as recited by claim 1, wherein said guard rail is comprised of a rigid plank covered with a padded covering.

3. A bed safety guard as recited by claim 1, wherein said attachment means comprises a plurality of screws applied through said first terminal ends into said guard rail.

4. A bed safety guard as recited by claim 1, further comprising:

a. a second guard rail positioned on the side of said mattress opposite to said guard rail;

b. second attachment means for securing said second guard rail to said second terminal end of said slats;

c. said first terminal ends having portions extending downwardly at fixed, substantially right angles and being disposed adjacent the side of the box spring, whereby said first terminal ends cooperate with said box spring to securely hold said second guard rail in place along said mattress.

5. A bed safety guard as recited by claim 4, wherein said second attachment means comprises a plurality of screws applied through said second terminal ends into said second guard rail.

6. A bed safety guard as recited by claim 1, wherein said guard rail comprises a U-shaped tube having a downward facing opening and being provided with a guard net fastened along an inner length thereof to form a barrier along a substantial portion of the length of said bed.

7. A bed safety guard as recited by claim 6, wherein said slats comprise a plurality of cross bed tubes extending transversely across said mattress, and having first and second terminal ends, said second terminal ends extending downwardly adjacent a box spring of said bed and said first terminal ends pointing upward, and said guard rail has a plurality of tapered ends adapted to securely seat within said first terminal ends and to be releasably held therewithin by said attachment means.

8. A bed safety guard as recited by claim 7, wherein said attachment means comprises a plurality of spring loaded buttons adapted to be received by apertures in walls of said first terminal ends.

* * * * *